United States Patent [19]

Tanaka et al.

[11] Patent Number: 5,063,970

[45] Date of Patent: Nov. 12, 1991

[54] LOOM WITH DEVICE FOR AUTOMATICALLY EXCHANGING CLOTH BEAMS

[75] Inventors: Kazuhiro Tanaka, Tachikawa; Shuichi Kojima, Tokyo; Susumu Kaneko, Akikawa; Takayuki Chikuma, Musashino, all of Japan

[73] Assignee: Nissan Motor Co., Ltd., Yokohama, Japan

[21] Appl. No.: 534,638

[22] Filed: Jun. 7, 1990

[30] Foreign Application Priority Data

Jun. 8, 1989 [JP] Japan ..... 1-144121
Aug. 10, 1989 [JP] Japan ..... 1-207504

[51] Int. Cl.[5] ..... D04D 49/20

[52] U.S. Cl. ..... 139/1 R; 139/291 R; 139/291 C; 242/58.3; 242/66

[58] Field of Search ..... 139/1 R, 291 R, 291 C; 242/66, 56 R, 58, 58.1, 58.2, 58.3, 58.4, 58.5; 28/201, 208

[56] References Cited

U.S. PATENT DOCUMENTS 3,707,995 1/1973 Pfarrwaller ..... 139/1 R
4,196,865 4/1980 Patriksson ..... 242/56 R
4,606,381 8/1986 Suwa et al. .
4,892,119 1/1990 Hugo et al. ..... 139/1 R

FOREIGN PATENT DOCUMENTS 78493 5/1983 European Pat. Off. .
1-97241 4/1989 Japan .
2085413 4/1982 United Kingdom .
86/01186 2/1986 World Int. Prop. O. .

*Primary Examiner*—Andrew M. Falik
*Attorney, Agent, or Firm*—Foley & Lardner

[57] ABSTRACT

A loom for automatically exchanging a full cloth beam for an empty one without stopping its weaving operation. The loom has a driving mechanism for driving a cloth beam to rotate and wind thereon woven fabric. After having wound thereon a predetermined amount of woven fabric, the cloth beam is ejected by an ejector mechanism and moved from the driving mechanism to a cloth beam support to be supported thereon. A cloth beam holder holding thereon an empty cloth beam, has a supplying mechanism for supplying the empty cloth beam to the driving mechanism. The ejector mechanism and the supplying mechanism are mechanically connected so as to operate in timed relation to each other. The woven fabric is separated from the full cloth beam by a cutting mechanism and has a loom side cut end portion. The loom side cut end portion of the woven fabric is wound on the empty cloth beam by a winding mechanism. The winding mechanism includes three kinds of air nozzles for blowing the loom side cut end portion of the woven fabric in desired directions. The cutter mechanism includes a fluid-drive rotary cutter blade driven at a high speed so that the cutting of woven fabric in a loose state is enabled.

30 Claims, 14 Drawing Sheets

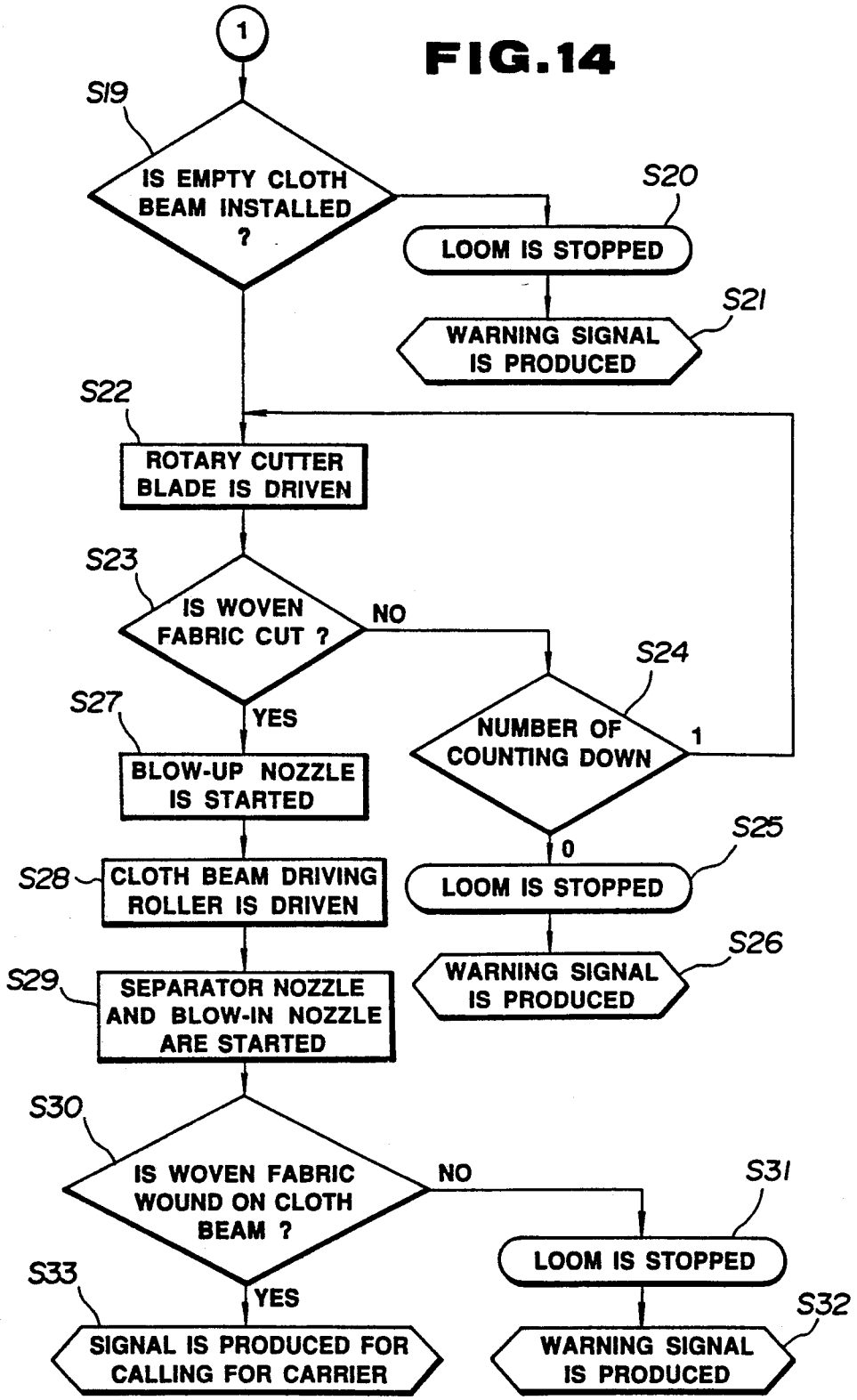
1
FIG.14
S19
IS EMPTY CLOTH BEAM INSTALLED ?
S20
LOOM IS STOPPED
S21
WARNING SIGNAL IS PRODUCED
S22
ROTARY CUTTER BLADE IS DRIVEN
S23
IS WOVEN FABRIC CUT ?
NO
S24
NUMBER OF COUNTING DOWN
1
0
S25
LOOM IS STOPPED
S26
WARNING SIGNAL IS PRODUCED
S27
YES
BLOW-UP NOZZLE IS STARTED
S28
CLOTH BEAM DRIVING ROLLER IS DRIVEN
S29
SEPARATOR NOZZLE AND BLOW-IN NOZZLE ARE STARTED
S30
IS WOVEN FABRIC WOUND ON CLOTH BEAM ?
NO
S31
LOOM IS STOPPED
S32
WARNING SIGNAL IS PRODUCED
S33
YES
SIGNAL IS PRODUCED FOR CALLING FOR CARRIER

LOOM WITH DEVICE FOR AUTOMATICALLY EXCHANGING CLOTH BEAMS

BACKGROUND OF THE INVENTION

1. Field of the Invention

The present invention relates to a loom equipped with a device for automatically exchanging a cloth beam for new one.

2. Description of the Prior Art

In order to increase the operation rate of a loom, it has recently been proposed to automatically exchange a full cloth beam for empty one without stopping the loom. The term "full cloth beam" is herein used to indicate a cloth beam on which a predetermined length of woven fabric is wound. On the other hand, the term "empty cloth beam" is used to indicate a cloth beam on which no woven fabric is wound.

Automatic exchange of cloth beams in a loom using a truck is known as disclosed in U.S. Pat. No. 4,606,381. A loom equipped with a device for automatically exchanging cloth beams is also known, as disclosed in Japanese Provisional Patent Publication No. 1-97241.

The prior art cloth beam exchanging devices however are not satisfactory in the reliability in operation, simplicity and compactness in structure and cost.

SUMMARY OF THE INVENTION

In accordance with the present invention, there is provided a loom which comprises driving means for driving a first cloth beam to rotate and wind woven fabric thereon, ejecting means for ejecting said first cloth beam from said driving means when a predetermined length of woven fabric is wound thereon, a cloth beam support stand for supporting said first cloth beam ejected from said driving means, a cloth beam holder for holding a second cloth beam and having supplying means operable in timed relation to said ejecting means for supplying said second cloth beam from said holder to said driving means, cutter means for cutting the woven fabric and thereby separating the same from said first cloth beam, and winding means for winding a loom side cut end portion of the woven fabric on said second cloth beam supplied to said driving means and having means for blowing fluid for placing the loom side cut end portion of the woven fabric on said second cloth beam.

The above structure is effective for overcoming the above noted disadvantages or shortcomings inherent in the prior art devices.

It is accordingly an object of the present invention to provide a novel device for automatically exchanging cloth beams in a loom, which is of the type built in the loom and is compact in structure, reliable in operation and ecconomical in cost.

It is a further object of the present invention to provide a novel cloth beam exchanging device of the above described character which is suited for retaining a space for movement of a carrier between the looms and therefore suited for automatic conveyance or transfer of full cloth beams using carriers in a factory.

BRIEF DESCRIPTION OF THE DRAWINGS

FIGS. 13 and 14 are flowcharts illustrating the operation of a control unit of the cloth beam exchanging device of FIG. 1;

DESCRIPTION OF THE PREFERRED EMBODIMENTS

Figure 1:
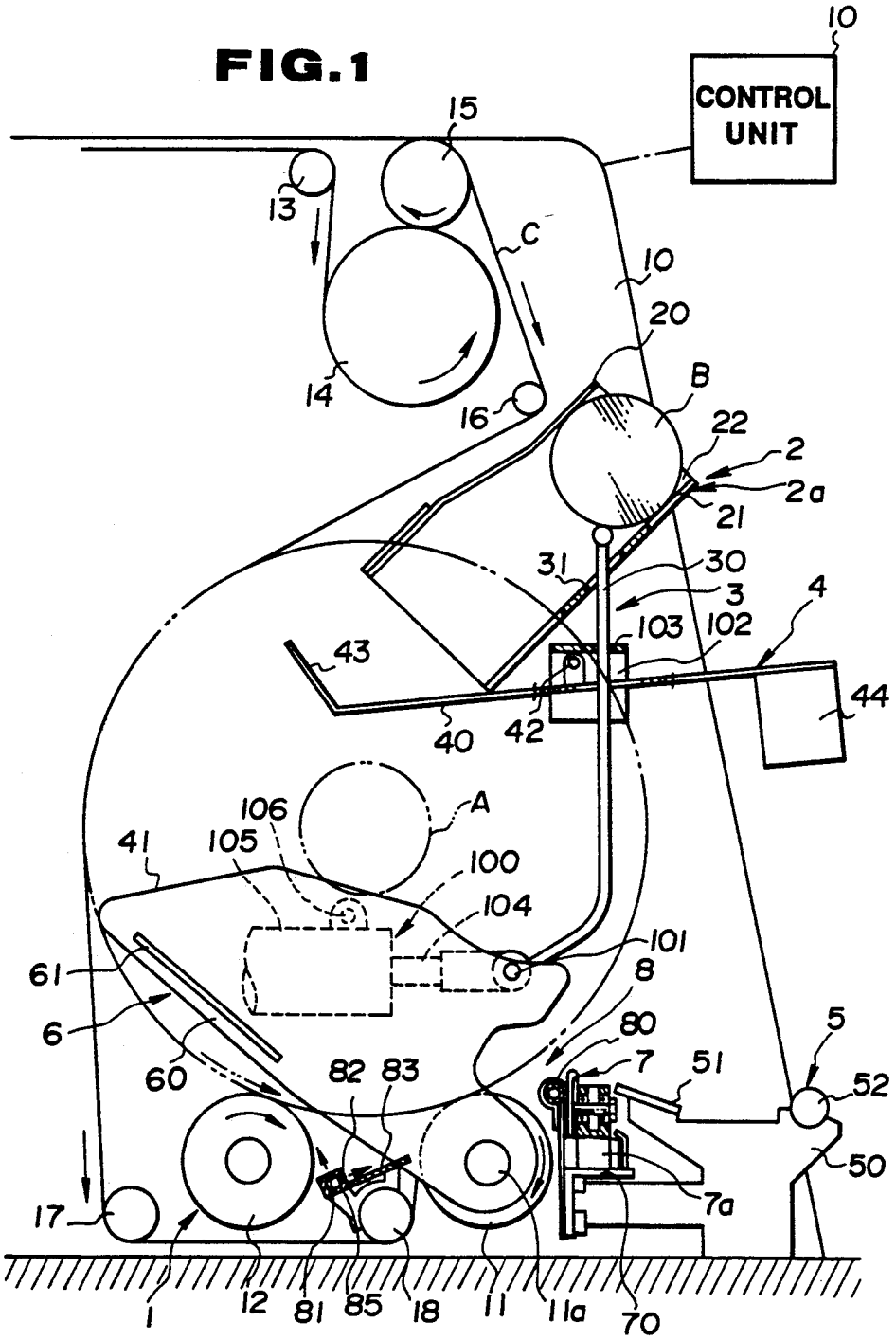
FIG. 1 is a partly sectional, schematic side elevation of a device for automatically exchanging cloth beams in a loom according to an embodiment of the present invention.

Referring to FIGS. 1 to 6, a loom has a built-in device for automatically exchanging a full cloth beam for empty one according to an embodiment of the present invention.

The automatic cloth beam exchanging device consists of a cloth beam driving mechanism 1, an empty cloth beam holder 2 having a releasing mechanism 3, a damper mechanism 4, a full cloth beam support stand 5, a full cloth beam ejecting mechanism 6, a cutter mechanism and a winding mechanism 8.

The cloth beam driving mechanism 1 is of the so-called surface drive type and includes a pair of parallel front and rear rollers 11 and 12 extending transversely of the loom, i.e., extending between opposite side frames 10 and 10 of the loom and rotatably installed on the front lower end portions thereof. The terms "front" and "rear", "forwardly" and "rearwardly", etc. are herein used to indicate the positions and directions in the loom on the basis of the understanding that a warp beam is disposed at the "rear" of the loom and warp threads are supplied "forwardly" therefrom. The cylindrical outer peripheral portions of the rollers 11 and 12 are made of synthetic rubber or the like material so as to have a sufficient durability and frictional resistance to movement of a woven fabric relative thereto. One of the rollers 11 and 12, i.e., in this embodiment the rear roller 12 is drivingly connected to a surface roller 14 by way of a power transmitting mechanism including a chain, timing belt or the like. The surface roller 14 is installed on the side frames 10 and 10 at the front upper end portions thereof. When a cloth beam "A" is installed on the front and rear rollers 11 and 12 and the rear roller 12 is driven to rotate in the direction of the arrow in FIG. 1, the cloth beam "A" is frictionally driven in the direction indicated by the arrow while driving the front roller 11 in the opposite direction. A woven fabric "C" coming out of a reed (not shown) of the loom is wound on the cloth beam "A" after passing sequentially through a guide bar 13, surface roller 14, press roller 15, upper guide bar 16 adjacent the surface roller 14, lower guide bar 17 adjacently rearward of the rear roller 12, bent bar 18 between the front and rear rollers 11 and 12 and the space between the cloth beam "A" and the front roller 11.

The empty cloth beam holder 2 includes a pair of holder members 2*a* and 2*a* located above the front and rear rollers 11 and 12 and secured to the respective side frames 10 and 10. Each holder member 2*a* has a channel-shaped support portion consisting of an upper wall 20, a lower wall 21 and a vertical wall between the outer ends of the upper and lower walls 20 and 21. The holder members 2*a* and 2*a* are constructed and arranged so that an empty cloth beam "B" is movably received at the opposite axial end portions thereof in the channel-shaped support portions. Further, the holder members 2*a* and 2*a* are arranged so that the lower walls 21 descend toward the front and rear rollers 11 and 12. The empty cloth beam "B" has the same structure as the cloth beam "A".

The empty cloth beam holder 2 has a releasing mechanism 3 which is movable between a position where it allows the empty cloth beam "B" to be held within the holder members 2*a* and 2*a* and a position where it allows the empty cloth beam "B" to be released from the holder members 2*a* and 2*a*. The releasing mechanism 3 includes upstanding stopper bars 30 and 30 capable of protruding at the upper end portions thereof into the respective holder members 2*a* and 2*a* through elongated openings 31 formed in the lower walls 21 of each holder members 2*a* and 2*a* to abut upon the opposite axial end portions of the empty cloth beam "B" and thereby hold the same in the holder members 2*a* and 2*a*. When the upper end portions of the stopper bars 30 and 30 withdraw from the inside of the holder members 2*a* and 2*a*, the empty cloth beam "B" moves down on the lower walls 21 and 21 of the holder members 2*a* and 2*a* due to the weight of itself and is released from the empty cloth beam holder 2 to fall toward the front and rear rollers 11 and 12.

The damper mechanism 4 includes a pair of damper arms 40 and 40 disposed between the respective empty cloth beam holders 2 and the cloth beam driving mechanism 1 for catching the empty cloth beam "B" released from the empty cloth beam holder 2 and on the way to the front and rear rollers 11 and 12. The damper mechanism 4 further includes cams 41 and 41 for contact with the damper arms 40 and 40 for controlling operation thereof. The damper arms 40 and 40 are elongated in the front-to-rear direction of the loom. The intermediate portion of each damper arm 40, i.e., the portion intermediate between the opposite longitudinal ends thereof is swingably installed by a pin 42 on a guide bracket 102 which is in turn installed on the corresponding side frame 10. Each damper arm 40 has an obtusely angled rear end portion 43 and is provided with a weight 44 at a front end thereof. The weight 44 is designed so as to make the angled rear end portion 43, when not supporting the empty cloth beam "B", turn upwards about the pin 42 and therefore the damper arm 40 abut upon the lower wall 21 of the corresponding holder member 2*a* and, when supporting the empty cloth beam "B", turn downwards about the pin 42 due to the weight of the empty cloth beam "B". The damper arms 40 and 40 are adapted, during the downward movement of the angled rear end portions 43, not to interfere with the releasing mechanism 3 of the empty cloth beam holder 2, the full cloth beam ejecting mechanism 6, etc.

The full cloth beam support stand 5 is used for supporting the full cloth beam "A" on which a predetermined length of woven fabric "C" is wound. The support stand 5 is arranged in the place forward of the front roller 11 and installed on the side frames 10 and 10.

More specifically, the full cloth beam support stand 5 includes an elongated base block 50 disposed between the side frames 10 and 10 and having at a rear upper end portion thereof an inclined support plate 51 descending forwardly and at a front upper end portion thereof a support bar 52. The support plate 51 and support bar 52 are spaced apart a predetermined distance in the front-to-rear direction of the loom and adapted to support thereon the full cloth beam "A", i.e., adapted to support the outer periphery of the rolled woven fabric of the cloth beam "A".

The full cloth beam ejecting mechanism 6 is installed on the side frames 10 at the front lower end portions thereof for driving the full cloth beam "A" out of the place on the front and rear rollers 11 and 12 and placing the same on the full cloth beam support stand 5. To this end, the ejecting mechanism 6 includes a pair of vertical base plates 60 rotatably installed at one end portions thereof on a support shaft 11*a* of the front roller 11. Each base plate 60 has at the other end portion thereof an ejecting arm 61 in the form of an elongated plate and projecting inwardly of the loom. The ejecting arms 61 and 61 are arranged so as to descend forwardly when brought into contact with the cloth beam "A" on the front and rear rollers 11 and 12 and assume nearly vertical positions when the cloth beam "A" is about to go over the front roller 11 being driven by the ejecting arms 61 and 61. In this connection, when the ejecting arms 61 and 61 are in their rest positions or rearmost positions, they are positioned so as to decend forwardly, i.e., they are inclined toward the front and rear rollers 11 and 12 so as to be capable of introducing the empty cloth beam "B" into the space between front and rear rollers 11 and 12.

The above described cams 41 and 41 of the damper mechanism 4 are formed integrally with the pivotal base plates 60 of the full cloth beam ejecting mechanism 6. That is, the cams 41 and 41 are formed in the other end portions of the respective pivotal base plates 60 for controlling the operation of the damper arms 40 and 40 in such a manner that, when the base plates 60 and 60 of the ejecting mechanism 6 are in their rearmost positions or rest positions, the angled rear end portions 43 and 43 of the damper arms 40 and 40 turn downwardly about the pins 42 and 42 and into the positions where they release the empty cloth beam "B".

More specifically, the cams 41 and 41 are moved into the positions where they are capable of supporting the damper arms 40 and 40 nearly horizontally prior to releasing of the empty cloth beam "B" from the empty cloth beam holder 2 and operative to allow the damper arms 40 and 40 to turn downwardly about the pins 42 and 42 and into the positions where the angled rear end portions 43 and 43 release the empty cloth beam "B" after the upper ends of ejecting arms 61 and 61 of the ejecting mechanism 6 are positioned at least rearward of the empty cloth beam "B". The base plates 60 and 60 of the full cloth beam ejecting mechanism 6 are adapted to return to the rearmost or rest positions before the empty cloth beam "B" is released from the angled rear end portions 43 and 43 of the damper arms 40 and 40.

The cutter mechanism 7 is disposed between the front roller 11 and the full cloth beam support stand 5 and has a cutter carrier 7*a* (refer to FIG. 7) adapted to move from one of the side frames 10 and 10 to the other (i.e., in the direction normal to the surface of the drawing of FIG. 1) being guided by a cutter guide 70 to cut the woven fabric "C" in the place between the full cloth beam "A" on the full cloth beam support stand 5 and the empty cloth beam "B" on the front and rear rollers 11 and 12.

Figure 7:
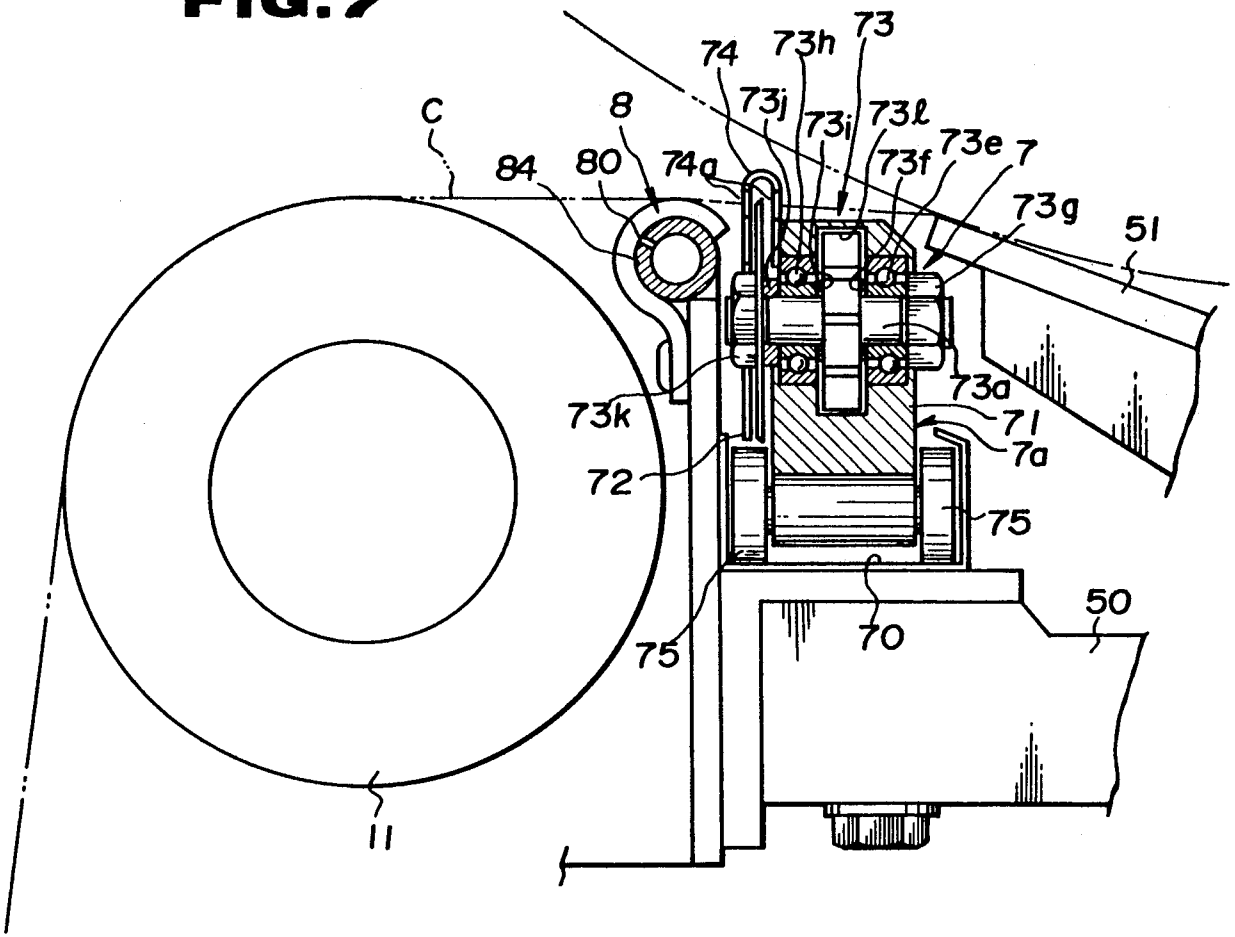
FIG. 7 is an enlarged, partly sectional, schematic side elevation of a cutter mechanism of the cloth beam exchanging device of FIG. 1.
Figure 10:
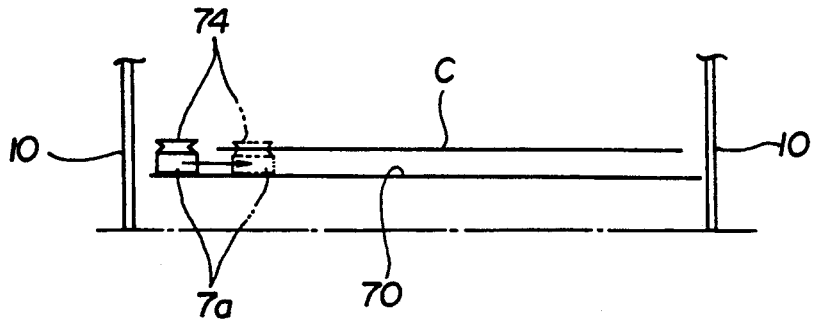

The cutter mechanism 7 is described more in detail with reference to FIGS. 7 and 10. The cutter mechanism 7 mainly consists of the cutter carrier 7*a* having a carrier body 71, a rotary cutter blade 72 rotatably installed on the carrier body 71, a turbine 73 serving as a fluid-drive motor for driving the rotary cutter blade 72 and a carrier drive unit 77. The turbine 73 includes a turbine rotor 73*a* consisting of a cylindrical rotor body 73*b*, a plurality of vanes 73*c* on the periphery of the rotor body 73*b* and integral with the same and a concentric rotor shaft 73*d*. The rotor shaft 73*d* projects forwardly from the rotor body 73*b* to have a front side portion on which an inner spacer 73*f* and a bearing 73*e* are installed and secured thereto with a nut 73*g*. The rotor shaft 73*d* also projects rearwardly from the rotor body 73*b* to have a rear side portion on which a bearing 73*h*, an inner spacer 73*i* and an outer spacer 73*j* are installed and secured thereto with a nut 73*k*. The turbine rotor 73*a* is rotatably installed in the carrier body 71 by disposing the rotor body 73*b* and vanes 73*c* in a turbine chamber 731 formed in the carrier body 71 and supporting the rotor shaft 73*d* upon the carrier body 71 by way of the bearings 73*e* and 73*h*. An inlet 73*m* and outlet 73*n* in communication with the turbine chamber 731 are formed in the carrier body 71. The inlet 73*m* is connected with a hose plug 73*o* which is in turn connected with a piping member 73*p* as a flexible vinyl tube. The other end of the piping member 73*p* is connected with an unshown pressurized fluid source as an air pump, air tank, etc. by way of an electromagnetic directional control valve (not shown).

The rotary cutter blade 72 is installed on the rear side portion of the rotor shaft 73*d* and secured thereto together with the bearing 73*h* and the spacers 73*i* and 73*j* with the nut 73*k* to rotate together therewith. The rotary cutter blade 72 is arranged so as to be spaced rearwardly from the carrier body 71. A cover 74 is installed on the carrier body 71 for covering the rotary cutter blade 72. The cover 74 has a dual-walled portion for covering an upper peripheral portion of the rotary cutter blade 72. The dual-walled portion of the cover 74 is formed with a pair of horizontal slits 74*a* and 74*b* opposed in the lateral direction of the loom for exposing horizontally opposed, upper peripheral portions of the rotary cutter blade 72. The left and right carrier rollers 75 and 76 are installed on the cutter guide 70 so that the cutter carrier 7*a* is movable laterally of the loom, i.e., in the left-hand and right-hand directions in FIG. 8 being guided by the cutter guide 70. The carrier drive unit 77 includes a base plate 77*a* disposed between the side frames 10 and 10. A drive motor 77*b* is installed on one lateral end portion of the base plate 77*a* and located laterally outward of one longitudinal end of the cutter guide 70. A driven pulley 77*d* is installed on the other end portion of the base plate 77*a* and located laterally outward of the other longitudinal end of the cutter guide 70. The motor 77*b* is connected with a driving pulley 77*c*. A wire 77*e* is placed around the driving and driven pulleys 77*c* and 77*d* and connected at one end to one lateral end of the carrier body 71 by way of a spring 77*f* and at the other end to the other lateral end of the carrier body 71.

The winding mechanism 8 is provided for winding the loom side cut end portion "Ca" of the woven fabric "C" on the empty cloth beam "B" having supplied from the empty cloth beam holder 2 to the front and rear rollers 11 and 12. The winding mechanism 8 includes a blow-up nozzle 80, separator nozzle 81, blow-in nozzle 82 and a guide plate 73.

The blow-up nozzle 80 is disposed between the front roller 11 and the full cloth beam support stand 5 and adapted to blow air up to the peripheral surface of the empty cloth beam "B" just after the cutting of the woven fabric "C" so that the loom side cut end portion "Ca" of the woven fabric "C" is blown up to lie on the empty cloth beam "B".

Figure 11:
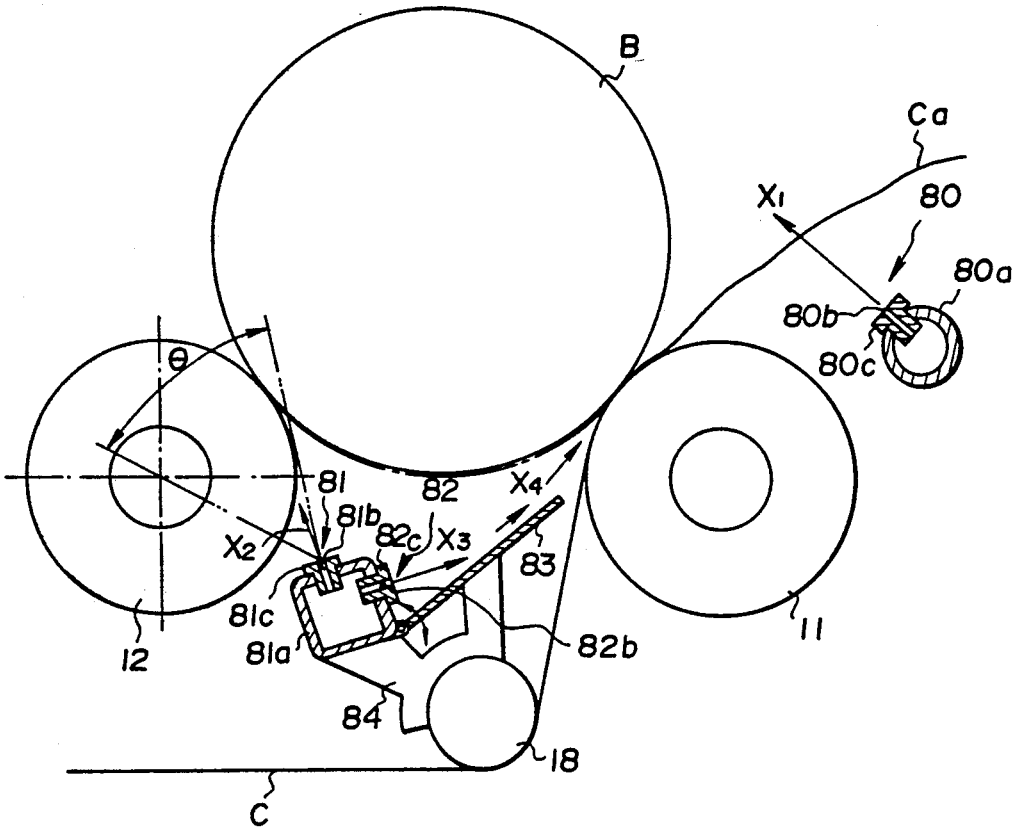
FIG. 11 is a view similar to FIG. 6 but shows, in an enlarged scale, a winding mechanism and its adjacent portion of the cloth beam exchanging device of FIG. 1.
Figure 12:
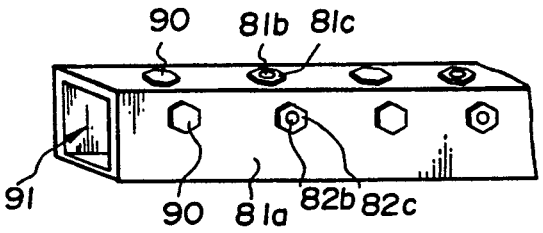
FIG. 12 is a perspective view of a square pipe formed with a plurality of injection ports, employed in the winding mechanism of FIG. 11.

The blow-up nozzle 80 consists of a pipe 80*a* extending substantially straightly in the width direction of the woven fabric "C" and installed on a rear wall of the cutter guide 70 and a plurality of injection ports 80*b* formed in the rear upper peripheral portion of the pipe 80*a* in such a way as to be spaced from each other in the lateral direction of the loom, i.e., in the width direction of the woven fabric "C". The pipe 80*a* has an end connected through an electromagnetic directional control valve (not shown) to a pressurized air source as an air pump or an air tank and the other end sealingly closed. The injection ports 80*b*, as shown in FIG. 11, are concentrically formed in respective plugs 80*c* which are in turn screwed into the peripheral wall of the pipe 80*a*.

The separator nozzle 81 is disposed between the front and rear rollers 11 and 12 for separating the cut end portion "Ca" of the woven fabric "C" from the rear roller 12 when it comes downwardly from the space between the empty cloth beam "C" and the rear roller 12 while lying on the rear roller 12. The separator nozzle 81 consists of a square pipe 81*a* secured to the bent bar 18 by means of a bracket 84 and a plurality of injection ports formed in the upper wall of the square pipe 81*a* in such a way as to be spaced from each other in the width direction of the woven fabric "C". The square pipe 81*a* is elongated substantially straightly in the width direction of the woven fabric "C" and communicated at one end with the above described pressurized air source through an electromagnetic directional control valve (not shown) independent from the above described directional control valve and sealingly closed at the other end so as to define a fluid passage 91 within the square pipe 81*a*. The injection ports 81*b* are, similarly to the above described injection ports 80*b*, concentrically formed in respective plugs 81*c* which are in turn screwed into the upper wall of the square pipe 81*a*.

The blow-in nozzle 82 is disposed between the front and rear rollers 11 and 12 for blowing the cut end portion "Ca" of the woven fabric "C" into the space between the empty cloth beam "B" and the front roller 11. The blow-in nozzle 82 is constituted by the above described square pipe 85 and a plurality of injection ports 82*b* formed in the front wall thereof in such a manner as to be spaced in the width direction of the woven fabric "C". The injection ports 82*b* are, similarly to the injection ports 81*b*, concentrically formed in plugs 82*c* which are in turn screwed into the front wall of the square pipe 81*a*.

The guide plate 83 is installed on the bracket 84 so as to guide the loom side cut end portion "Ca" of the woven fabric "C" which is blown by the air from the blow-in nozzle 82 into the space between the front roller 11 and the cloth beam B on the front and rear rollers 11 and 12.

The full cloth beam ejecting mechanism 6 and the releasing mechanism 3 of the empty cloth beam holder 2 are operative in timed relation to each other and adapted to be driven by the same air cylinders 100 and 100 installed on the respective side frames 10 and 10. More specifically, the stopper bars 30 and 30 of the releasing mechanism 3 extend downwardly to have the other end portions which are connected by means of pins 101 and 101 to the respective base plates 60 and 60 of the ejecting mechanism 6. The intermediate portions of the stopper bars 30 and 30 are movably received in guide holes 103 and 103 formed in the guide brackets 102 and 102 which are in turn installed on the side frames 10 and 10. The pins 101 and 101 are connected with piston rods 104 and 104 of the air cylinders 100 and 100. Cylinder tubes 105 and 105 of the air cylinders 100 and 100 are installed on the respective side frames 10 and 10 by means of pins 106.

With the above structure, the automatic cloth beam exchanging device built in the loom according to an embodiment of this invention operates as follows.

Figure 2:
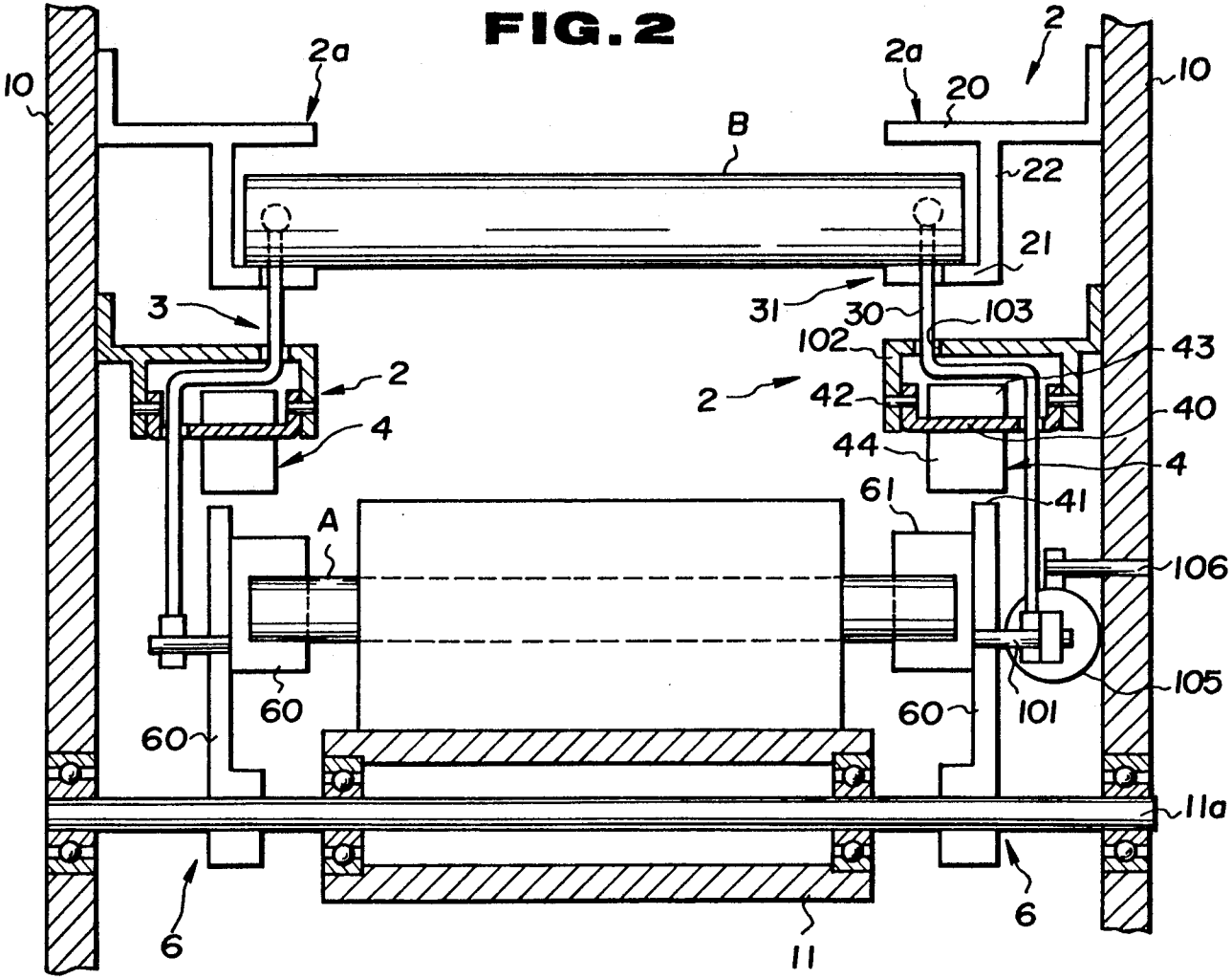
FIG. 2 is a partly sectional, schematic elevation of the cloth beam exchanging device of FIG. 1.
Figure 3:
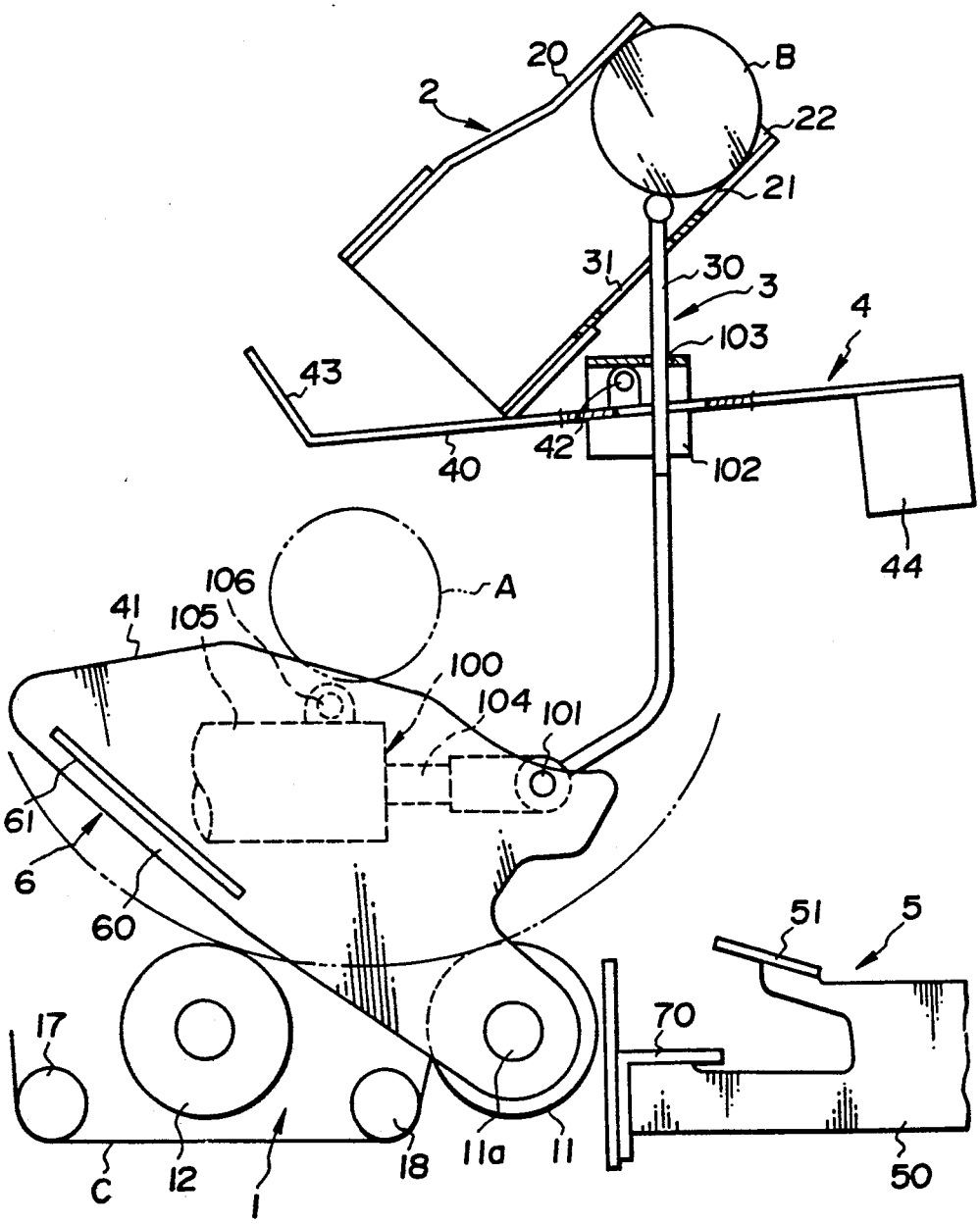
FIG. 3 is a view similar to FIG. 1 but shows the cloth beam exchanging device in an operative position where it is about to start exchanging a full cloth beam for empty one.
Figure 4:
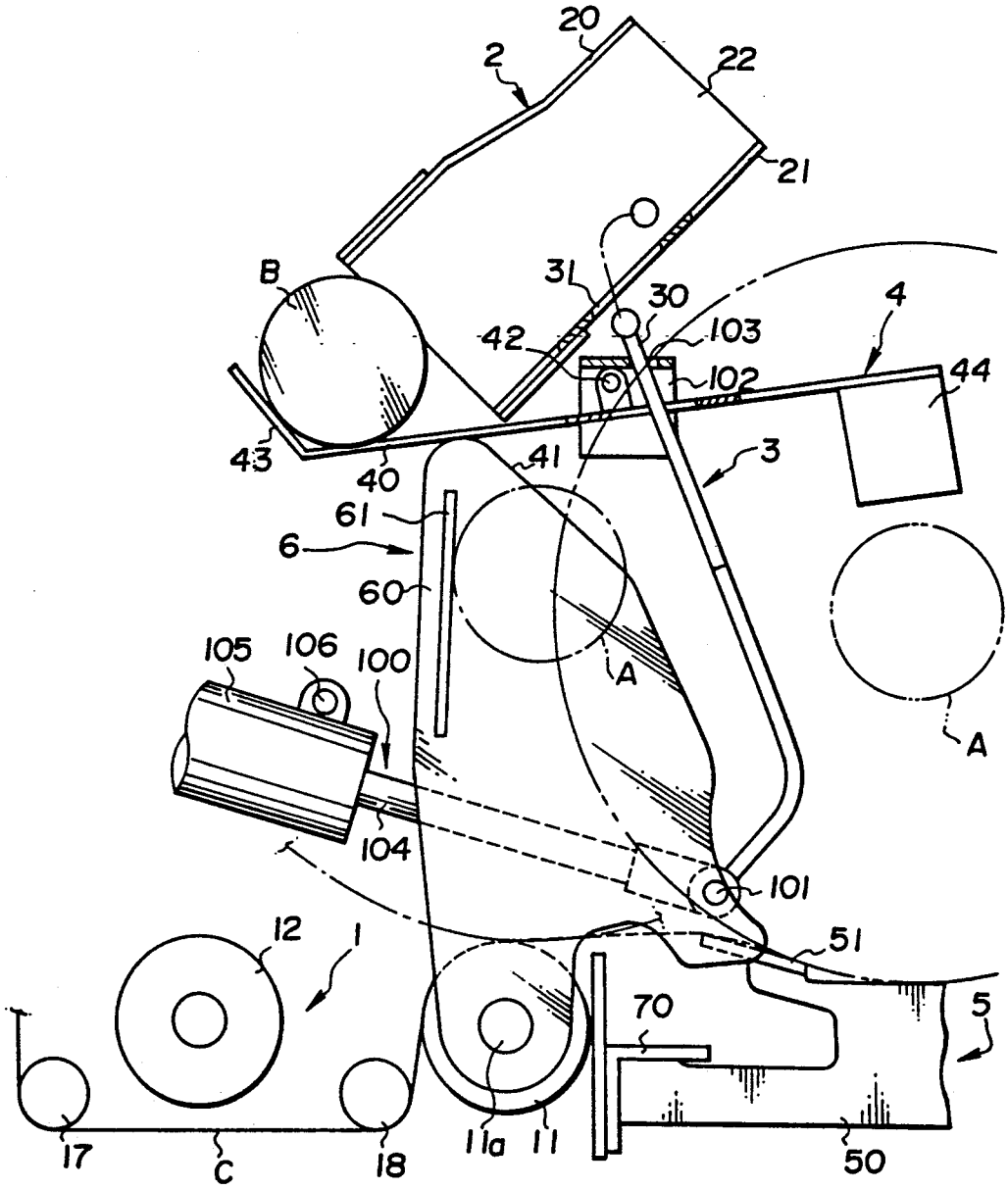
FIG. 4 is a view similar to FIG. 3 but shows the cloth beam exchanging device in an operative position where a full cloth beam is removed from a cloth beam driving mechanism and supported on a full cloth beam support stand.

When the piston rods 104 and 104 of the air cylinders 100 and 100 retract as shown in FIGS. 1–3 to place the ejecting arms 61 and 61 of the ejecting mechanism 6 at the rearmost or rest positions thereof while allowing the stopper bars 30 and 30 of the releasing mechanism 3 to protrude into the holder members 2*a* and 2*a* to hold the empty cloth beam "B" therewithin, the woven fabric "C" is wound on the cloth beam "A" on the front and rear rollers 11 and 12 of the cloth beam driving mechanism 1. When a predetermined length of woven fabric "C" is wound on the cloth beam "A", the air cylinders 100 and 100 are actuated so as to project the piston rods 104 and 104 outwards therefrom while continuing the weaving operation of the loom. Thus, as shown in FIG. 4, the ejecting arms 61 and 61 of the ejecting mechanism 6 turn forwardly about the supporting shaft 11*a* while driving the cloth beam "A" out of the place on the front and rear rollers 11 and 12 and beyond the uppermost portion of the front roller 11 so that the cloth beam "A" goes over the front roller 11 and moves forwardly by the effect of the weight of itself onto the full cloth beam support stand 5. In this instance, the woven fabric "C" extends continuously from the bent bar 18 through the front roller 11 and support plate 51 to the cloth beam "A" on the full cloth beam support stand 5. Further, by the forward movement of the ejecting arms 61 and 61 of the ejecting mechanism 6, the cams 41 and 41 are moved into the positions under the angled rear end portions 43 and 43 of the damper arms 40 and 40 and at the same time the stopper bars 30 and 30 of the releasing mechanism 3 withdraw from the inside of the holder members 2*a* and 2*a*, following the path indicated by the one-dot chain line in FIG. 4 and being guided by the guide holes 103 and 103. The empty cloth beam "B" thus moves down on the lower walls 21 and 21 of the holder members 2*a* and 2*a* due to the weight of itself and is caught by the angled rear end portions 43 and 43 of the damper arms 40 and 40. The angled rear end portions 43 and 43 having caught the cloth beam "B" turn downwards a little about the pins 42 and 42 due to the weight of the empty cloth beam "B" and come to contact the cams 41 and 41 to be supported thereon as shown in FIG. 4.

Figure 5:
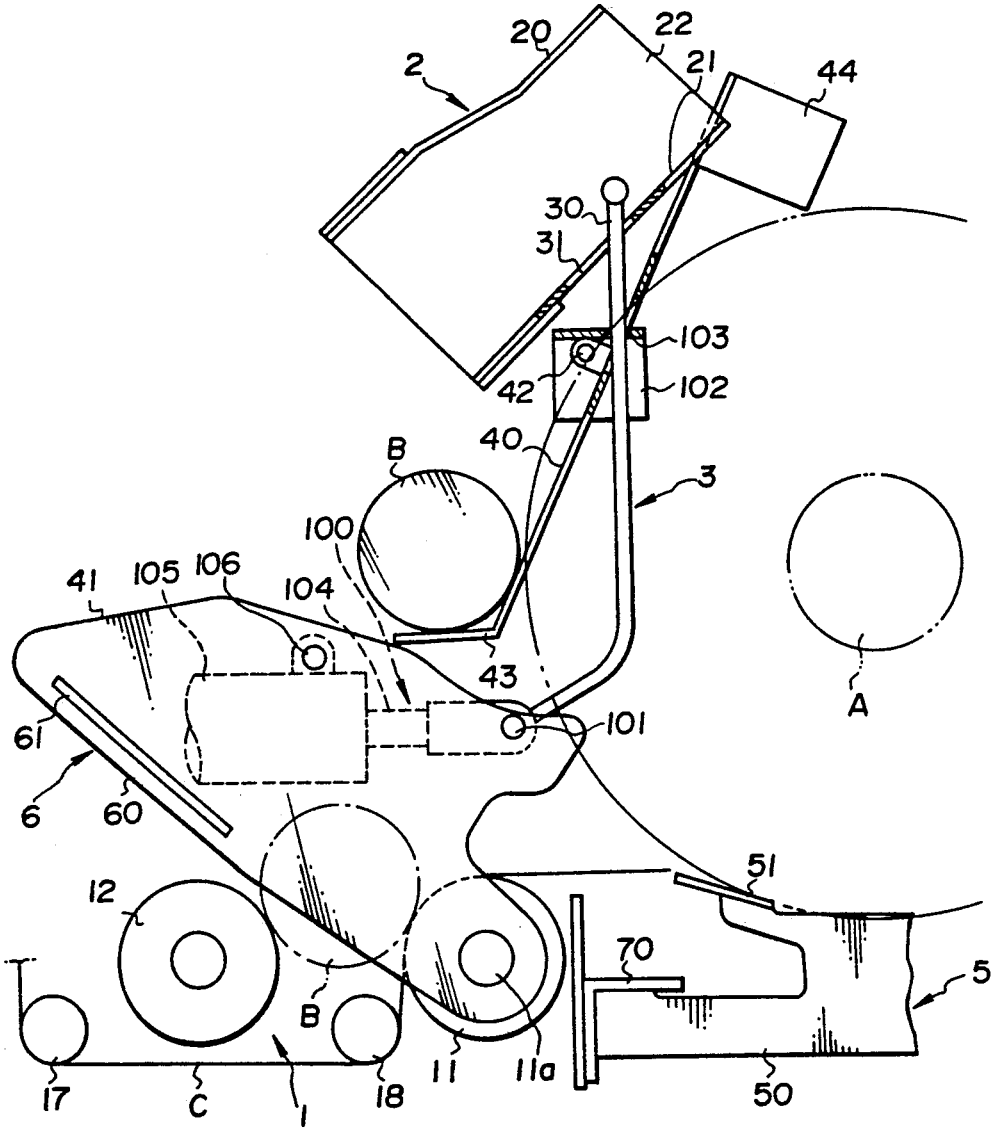
FIG. 5 is a view similar to FIG. 3 but shows the cloth beam exchanging device in an operative position where an empty cloth beam is released from an empty cloth beam holder and on the way to the cloth beam driving mechanism.

After the operative condition shown in FIG. 4 is obtained, the air cylinders 100 and 100 are actuated so as to retract the piston rods 104 and 104 thereinto. By this, the ejecting arms 61 and 61 of the ejecting mechanism 6 are turned rearwards about the support shaft 11*a*. When the upper ends of the ejecting arms 61 and 61 go rearwardly beyond the empty cloth beam "B" held by the angled rear end portions 43 and 43 of the damper arms 40 and 40 as shown in FIG. 5, the cams 41 and 41 are moved out of the positions under the angled rear end portions 43 and 43, thus allowing the angled rear end portions 43 and 43 of the damper arms 40 and 40 to turn downwards about the pins 42 and 42 under the control of the cams 42 and 42 and due to the weight of the empty cloth beam "B". The empty cloth beam "B" is thus released from the angled rear end portions 43 and 43 of the damper arms 40 and 40 and supplied onto the front and rear rollers 11 and 12 while being held parallel to the axes of the rollers 11 and 12 so as to be assuredly placed thereon. In this instance, such a case may occur in which the empty cloth beam "B" released from the angled rear end portions 43 first abut upon the ejecting arms 61 and 61 and is guided thereby so as to be assuredly placed on the front and rear rollers 11 and 12. Further, in response to the returning of the ejecting mechanism 6 to its rearmost or rest position, the stopper bars 30 and 30 of the releasing mechanism 3 intrude into the holder members 2*a* and 2*a* of the empty cloth beam holder 2.

Figure 6:
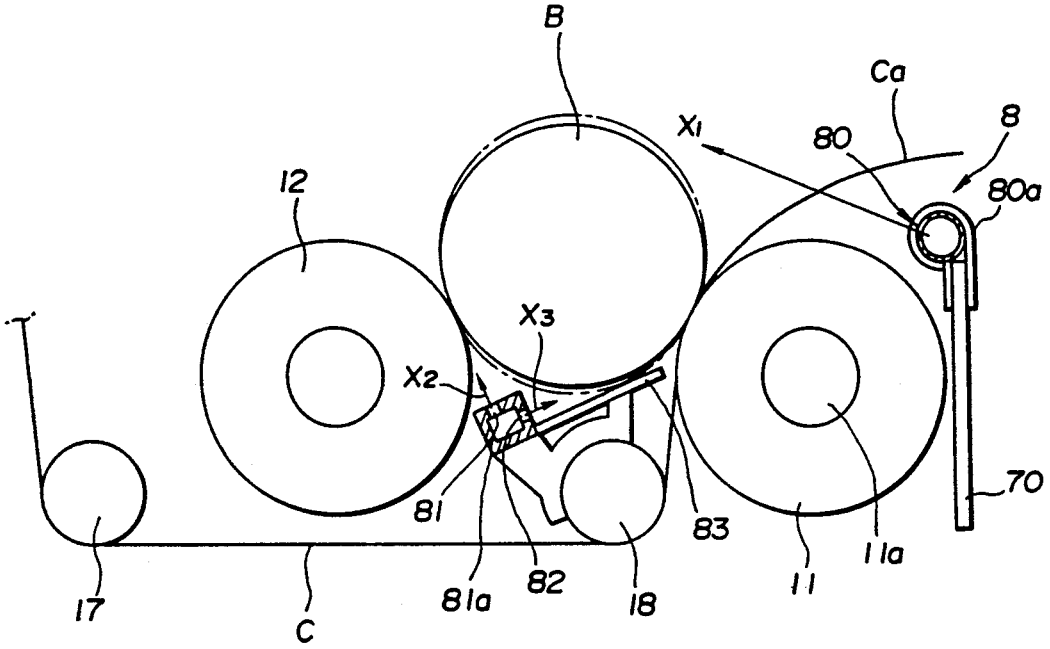
FIG. 6 is a partly sectional, schematic side elevation of the cloth beam driving mechanism and its adjacent portion of the cloth beam exchanging device of FIG. 1 in an operative position where a loom side cut end portion of woven fabric is being wound on an empty cloth beam supplied to the cloth beam driving mechanism.

Then, under the condition where, as shown in FIG. 5, the woven fabric "C" has a portion clamped between the empty cloth beam "B" and the front roller 11 and extends continuously from the front roller 11 to the cloth beam "A" held on the full cloth beam support stand 5, the cutter carrier 7*a* of the cutter mechanism 7 is moved from one side of the woven fabric "C" to the other for thereby cutting, as shown by the solid line in FIG. 6, the woven fabric "C" at a location between the empty cloth beam "B" on the front and rear rollers 11 and 12 and the full cloth beam "A" on the full cloth beam support stand 5.

Figure 8:
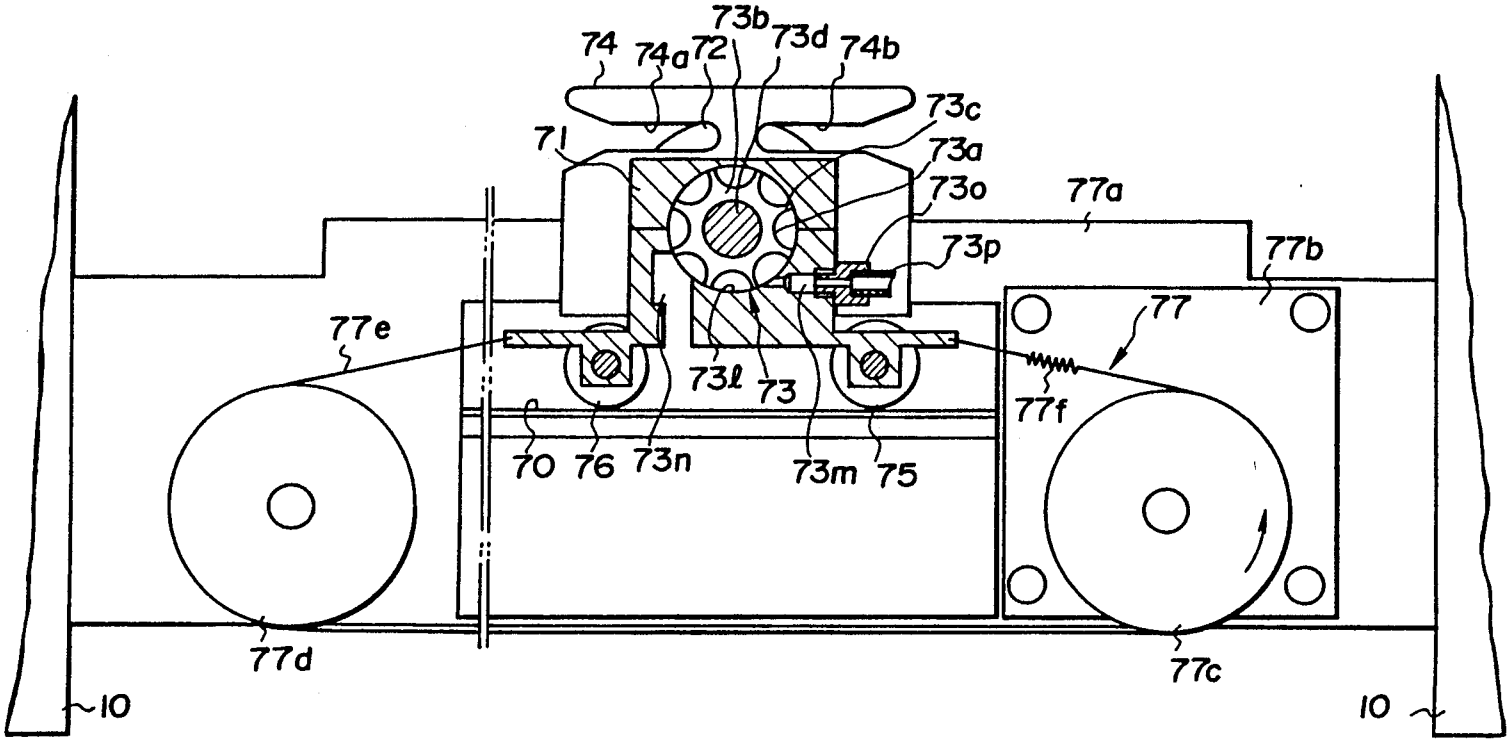
FIG. 8 is an elevation of the cutter mechanism of FIG. 7.
Figure 9:
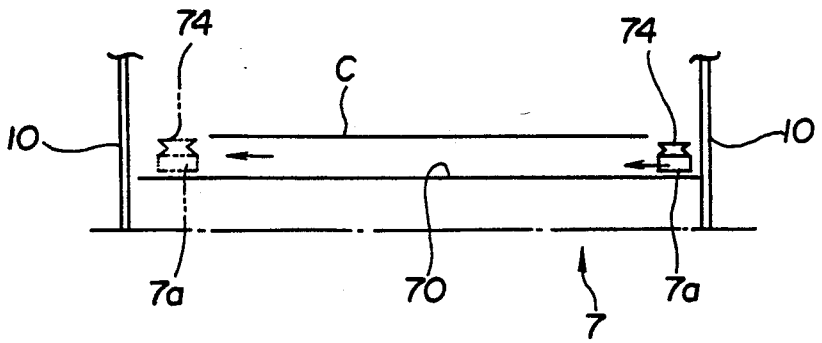
FIGS. 9 and 10 are schematic views for illustrating the operation of the cutter mechanism of FIG. 7 in relation to woven fabric.

More specifically, the motor 77*b* is actuated so as to rotate in a predetermined direction, i.e., in the anticlockwise direction in FIG. 8 before the cloth beam "A" is ejected from the front and rear rollers 11 and 12 and goes beyond the front roller 11. By this, the carrier drive unit 77 causes the cutter carrier 7*a* to move from the position laterally outward of one side of the woven fabric "C" as shown by the solid line in FIG. 9 to the position laterally outward of the other side of the woven fabric "C" as shown by the two-dot chain line in FIG. 9. That is, the cutter carrier 7*a* is first moved from one side of the woven fabric "C" to the other for thereby making ready for the cutting operation. Simultaneously with the above actuation of the motor 77*b*, pressurized fluid from the pressurized fluid source is supplied to the inlet 73*m* of the turbine 73, thus causing the turbine rotor 73*a* to rotate at high speed together with the rotary cutter blade 72. After the cutter carrier 7*a* is displaced from one side to the other of the woven fabric "C" as above and the full cloth beam "A" ejected from the front and rear rollers 11 and 12 goes beyond the front roller 11 to be supported on the full cloth beam support stand 5, the motor 77*b* is actuated so as to rotate reversely. By this, the cutter carrier 7*a* is driven to move in the opposite direction while introducing the woven fabric "C" into the slit 74*b*, i.e., the right-hand slit 74*b* in FIG. 8, and to the rotary cutter blade 72 and allowing the same to be cut thereby. When the cutter carrier 7*a* finishes cutting of the woven fabric "C" and is positioned laterally outward of the corresponding side of the woven fabric "C", the motor 77*b* is stopped for thereby stopping movement of the cutter carrier 7*a* and at the same time the supply of pressurized air to the turbine 73 is stopped.

Thereafter, by the winding mechanism 8, the loom side cut end portion "Ca" of the woven fabric "C" is wound on the empty cloth beam "B" installed on the front and rear rollers 11 and 12 as shown in FIG. 6. That is, the nozzles 80 first blow air in the direction of the arrow X1 so that the front roller side cut end portion "Ca" is laid on the empty cloth beam "B" and then stop blowing air after lapse of a predetermined time. By this, the loom side cut end portion "Ca" of the woven fabric "C" is laid on the outer periphery of the empty cloth beam "B" and moves together with the empty cloth beam "B". The cut end portion "Ca" then passes through the space between the rear roller 12 and the empty cloth beam "B" to project downwardly therefrom. At this time, the separator nozzles 81 and blow-in nozzles 82 blow air in the respective directions X2 and X3. By this, the loom side cut end portion "Ca" projecting from the rear roller 12 and the empty cloth beam "B" is separated from the rear roller 12 by the effect of the air from the separator nozzles 81 and thus passes through the space between the square pipe 81*a* and the empty cloth beam "B" to be blown toward the guide plate 83. In this instance, it is revealed by the experiments conducted by the applicants that the cut end portion "Ca" of the woven fabric "C" can be assuredly separated from the rear rollers 12 so long as the separator nozzle 81 injects or blows air in the direction X2 included within the angular range indicated by "$\theta$" in FIG. 11, i.e., within the angular range defined between, with respect to a plane of projection perpendicular to the axes of the front and rear rollers, the line extending from the injection port 81*b* and tangential to the outer periphery of the rear roller 12 and the line extending between the injection port 81*b* and the axis of rotation of the rear roller 12. Then, by the air blowing from the blow-in nozzles 82 to flow along the guide plate 83, the loom side cut end portion "Ca" is blown into the space between the empty cloth beam "B" and the front roller 11, i.e., blown into the space between the woven fabric "C" extending from the bent bar 18 to the front roller 11 and the empty cloth beam "B" for thereby being wound on the empty cloth beam "B" as indicated by the one-dot chain line in FIG. 6. In this instance, the blow-in nozzle 82 injects air in the direction X3 which crosses the front-to-rear direction of extension of the guide plate 83 and cooperates with the guide plate 83 to guide the air injected from the blow-in nozzle 82 in the direction X4 to the space between the cloth beam "B" and the front roller 11. By constructing so that the guide plate 83 is adjustable in inclination, i.e., movable forwardly and rearwardly as indicated by the arrows in FIG. 11, the blowing direction X4 can be adjusted suitably. Upon completion of the winding, the separating nozzles 81 and blow-in nozzles 82 stop blowing air. By this, one cloth beam exchanging cycle is completed.

When the above described loom side cut end portion "Ca" of the woven fabric "C" is blown into the space between the empty cloth beam "B" and the woven fabric "C" extending from the bent bar 18 and wound on the empty cloth beam "B", the front roller 11 may be forced to stop rotating or to rotate reversely while keeping the rear roller 12 and the empty cloth beam "B" rotating in the directions of the arrows in FIG. 1 with a view to making the cut end portion "Ca" become wound on the empty cloth beam "B" more firmly or tensely.

When the cloth beam exchanging cycle is finished, a cloth beam carrier is called to convey the full cloth beam "B" to a predetermined storing place as a cloth beam carrier store At the same time, a new cloth beam is supplied to the empty cloth beam holder 2 to ready for the next cloth beam exchange. In this connection, when the empty cloth beam "B" is supplied to the empty cloth beam holder 2, it is held thereat since the the stopper bars 30 and 30 of the releasing mechanism 3 are now positioned to intrude into the respective holder members 2*a* and 2*a* in response to returning of the full cloth beam ejecting mechanism 6 to its rest position.

Figure 13:
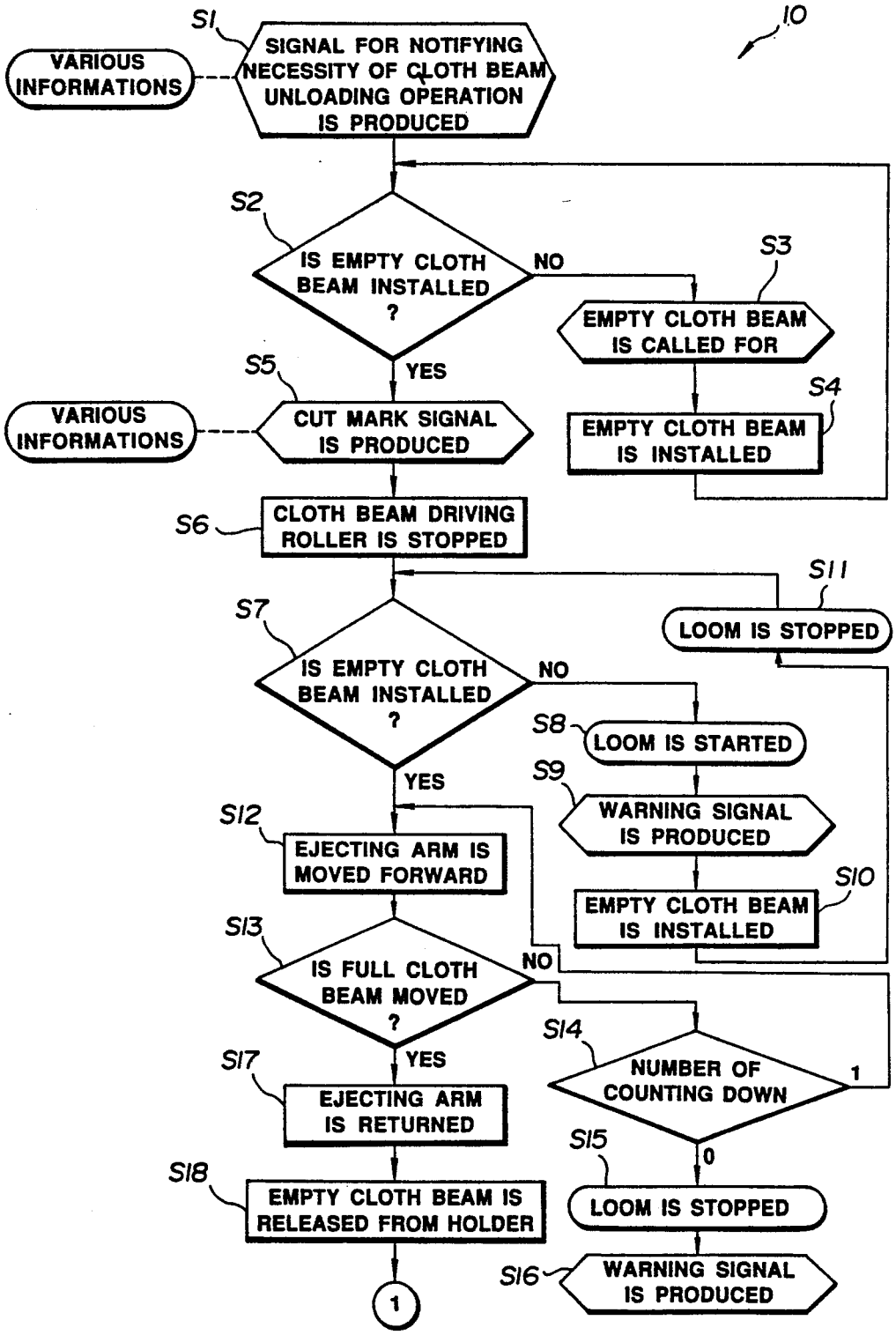

The above operation of the cloth beam exchanging device of this invention is controlled by a control unit 10 in such a way as shown in the flowcharts in FIGS. 13 and 14.

The control unit 10 is adapted to count the, number of picks to know the length of woven fabric based on the number of picks and the number of weft threads per unit length. Further, the control unit 10 can know the weaving operation time necessary for the cloth beam to wind thereon a predetermined length of woven fabric, on the basis of the above informations and the speed of operation of the loom.

On the basis of the necessary weaving operation time, a signal is produced at step "S1" and a predetermined time (e.g., 15 to 30 minutes) before a predetermined length (e.g., 150 m) of woven fabric is wound on the cloth beam "A" for notifying the necessity of a cloth beam unloading operation. At step "S2" it is judged whether an empty cloth beam "B" is installed on the empty cloth beam holder 2. When an empty cloth beam "B" is not installed on the empty cloth beam holder 2, a warning lamp is turned on to call for an empty cloth beam "B", i.e., to notify the worker of the fact so that he can supply an empty cloth beam "B" to the empty cloth beam holder 2 at step "S4".

When it is detected that an empty cloth beam "B" is installed in the empty cloth beam holder "2" or the above predected weaving operation time comes, the control proceeds to the step "S5". At step "S5", a cut mark signal is produced when it is detected that a predetermined length of woven fabric "C" is produced by the loom. At step "S6", when it is detected on the basis of the cut mark signal that a predetermined length of woven fabric "C" is wound on the cloth beam "A", the front roller 11 of the driving mechanism 1 is stopped but the surface roller 14, etc. are kept rotating to continue a weaving operation of the loom.

At step "S7", it is judged once again whether an empty cloth "B" is installed on the empty cloth beam holder "2". When it is detected that an empty cloth beam "B" is not installed on the empty cloth beam holder 2, the loom is stopped at step "S8", and a warning signal is produced at step "S9". When an empty cloth beam "B" is supplied at step "S10", the loom is started again at step "S11".

At step "S12", the ejecting arms 61 and 61 are actuated to eject the full cloth beam "A" out of the place on the front and rear rollers 11 and 12. By this, the full cloth beam "A" is supported on the full cloth beam support stand 5. At step "S12", before the full cloth beam "B" ejected from the front and rear rollers 11 and 12 goes beyond the front roller 11, the rotary cutter blade 72 is started to rotate and at the same time the motor **77*b* is actuated to rotate in a predetermined direction for moving the cutter carrier 7*a*** from one side of the woven fabric "C" to the other to make ready for a cutting operation as having been described above.

At step "S13", it is judged, by using a limit switch or the like installed on the full cloth beam support stand 5, whether the full cloth beam "A" is removed from the front and rear rollers 11 and 12 and supported on the full cloth beam support stand 5. When the full cloth beam "A" is not installed on the full cloth beam support stand 5, the control is returned back to step "S12" through the step "S14" to perform the above judgement again. When the full cloth beam "A" is still not installed on the full cloth beam support stand 5, the loom is stopped at step "S15" to produce a warning signal at step "S16".

When it is detected that the full cloth beam "A" is installed on the full cloth beam support stand 5, the ejecting arms 61 are returned to the rest positions at step "S17". Then, an empty cloth beam "B" is released from the empty cloth beam holder 2 at step "S18". In this connection, the steps "S17" and "S18" overlap with each other since the releasing mechanism 3 of the empty cloth beam holder 2 operates in timed relation to the ejector mechanism 6 as having been described hereinbefore.

At step "S19", it is judged whether the empty cloth beam "B" is released from the empty cloth beam holder 3 and installed on the front and rear rollers 11 and 12 by using a photoelectric sensor or the like disposed in the cloth beam driving mechanism 1. When it is detected that the empty cloth beam "B" is not installed on the front and rear rollers 11 and 12, the loom is stopped at step "S20", and an alarm signal is produced at step "21".

At step "S22", the motor **77*b* is actuated to rotate reversely to the above described predetermined direction for thereby moving the cutter carrier 7*a* in the corresponding direction and cutting the woven fabric "C". At step "S23", it is judged whether the woven fabric "C" is cut when the cutter carrier 7*a*** is moved into a predetermined position laterally outward of the corresponding side of the woven fabric "C" and finishes a cutting operation. When the woven fabric "C" is not cut, the control is returned through step "S24" to the step "S22" to perform a cutting operation again. When the woven fabric "C" is still not cut, the loom is stopped at step "S25" and an alarm signal is produced at step S26.

At step S27 the blow-up nozzle 80 is started to blow air for placing the loom side cut end portion "Ca" of the woven fabric "C" on the empty cloth beam "B". At step "S28", the rear roller 12 is started to rotate. At step 29, the separator nozzle 81 and blow-in nozzle 82 are started to blow air. By this, the cut end portion "Ca" of the woven fabric "C" coming from the space between the empty cloth beam "B" and the rear roller 12 is assuredly separated from the rear roller 12 and introduced into the space between the empty cloth beam "B" and the front roller 11 so as to be wound on the empty cloth beam "B". At step "S30", it is judged whether the loom side cut end portion "Ca" of the woven fabric "C" is wound on the empty cloth beam "B". When it is not detected that the cut end portion "Ca" of the woven fabric "C" is wound on the empty cloth beam "B", the loom is stopped at step "S31", and an alarm signal is produced at step "S32". At step "S33", a cloth beam carrier is called for to unload the full cloth beam "A" from the loom and convey it to a predetermined place as a cloth beam carrier store.

Figure 15:
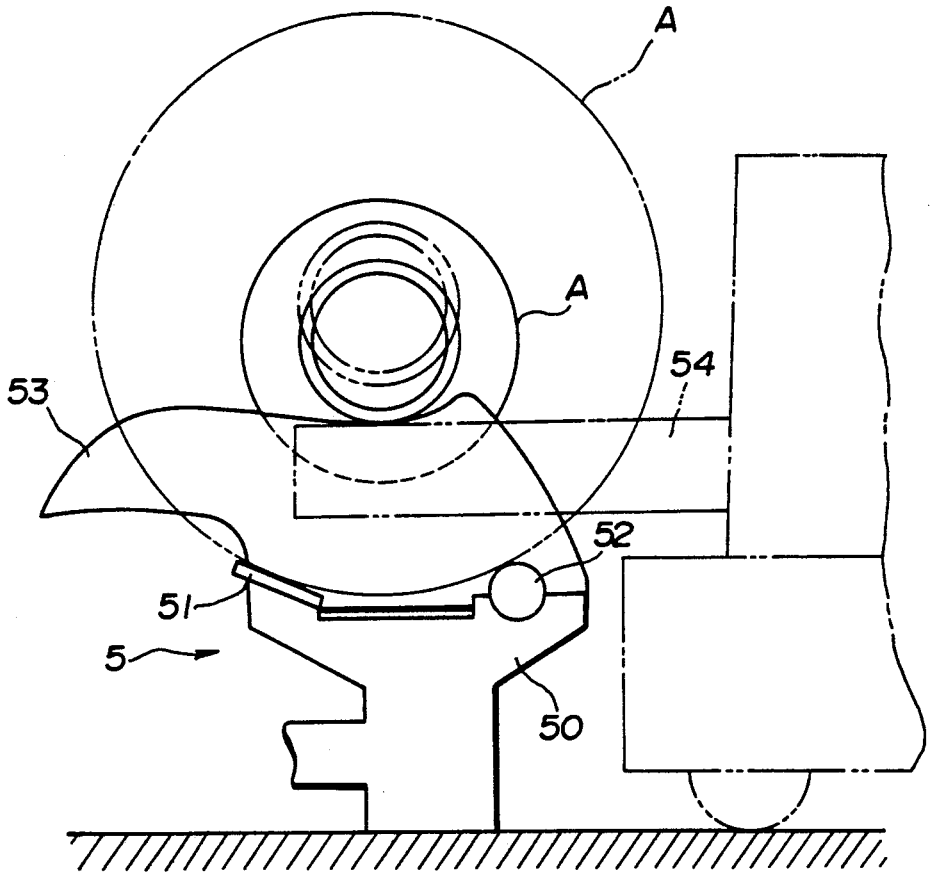
FIG. 15 is an enlarged schematic side elevation of a variant of the full cloth beam support stand.

FIG. 15 shows a variant of the full cloth beam support 5 in which a pair of secondary supports 53 in the form of vertical plates are installed on the base block 50 so as to support thereon the opposite end portions of the full cloth beam "A" projecting outwardly from the rolled woven fabric "C" when the outer diameter of the full cloth beam "A" is smaller than a predetermined value, i.e., the length of woven fabric "C" wound on the cloth beam "3A" is smaller than a predtermined value. When the outer diameter of the full cloth beam "A" is smaller than a predetermined value, a sufficient space for receiving therein a carrier arm 54 cannot be obtained between the opposite end portions of the full cloth beam "A" and the support stand 5. When the outer diameter of the full cloth beam "A" is larger than a predetermined value, i.e., the length of woven fabric "C" wound on the cloth beam "A" is larger than a predetermined value, the full cloth beam "A" is not supported at the opposite end portions on the secondary supports 53 but is supported at the outer periphery of the rolled cloth beam "C" on the empty cloth beam stand 5, thus providing a sufficient space between the opposite end portions of the cloth beam "A" and the support stand 5. By the provision of the secondary supports 53, even a cloth beam "A" of a small outer diameter can be unloaded from the loom with ease by using a cloth beam carrier.

In the foregoing, it is to be noted that the empty cloth beam "B" stored in the empty cloth beam holder 2 is adapted to fall on the cloth beam driving mechanism 1 stepwisely by means of the damper mechanism 4, it becomes possible to assuredly hold the empty cloth beam "B" in parallel to the front and rear rollers 11 and 12 while at the same time to reduce the striking force or impact against the cloth beam driving mechanism 1.

It is further to be noted that the releasing mechanism 3 of the empty cloth beam holder 2 and the ejecting mechanism 6 are mechanically connected so as to operate in timed relation to each other, thus making it possible to control the timing at which the empty cloth beam "B" is released from the empty cloth beam holder 2 can be controlled accurately and assuredly.

It is further to be noted that the cams 41 and 41 of the damper mechanism 4 are formed integral with the base plates 60 and 60 of the ejecting mechanism 6, thus making it possible to control the timing at which the empty cloth beam holder "B" is released from the damper arms 40 and 40 accurately and assuredly.

It is still further to be noted that the cutter mechanism 7 does not require the woven fabric "C" to be tense or stretched when the woven fabric "C" is to be cut thereby. The cutting mechanism 7 can attain a beautifully or clearly cut end when the woven fabric "C" is cut in a loose state, i.e., can cut the woven fabric "C" in a loose state without causing any deffect, i.e., without substantially causing any unwoven or separated threads at the cut end portion "Ca". This is because the rotary turbine blade 72 is driven by the fluid-drive motor, i.e., by the turbine 73 to rotate at high speed, e.g., at the speed ranging from about 30,000 to 60,000 rpm. The rotary cutter blade 72 can be rotated at such high speed by the combination of the rotary cutter blade 72 and the turbine 72 serving as a fluid-drive motor according to this invention.

It is still further to be noted that the winding mechanism 8 consists of three kinds of air nozzles and can assuredly wind the loom side cut end portion "Ca" of the woven fabric "C" on a new cloth beam "B". The winding mechanism 8 is simple and compact in structure but reliable in operation.

It is still further to be noted that the driving mechanism 1, the cutter mechanism 7 and the winding mechanism 8 are adapted to be actuated by pressurized fluid as pressurized air or pressurized water. Such pressurized air or water is available with ease, particularly in case of an air jet loom or water jet loom and therefore this makes it possible for making the cloth beam exchanging device further compact in size, simple in structure and reliable in operation.

It is still further to be noted that the empty cloth beam stocker 2 and the ejecting mechanism 6 are constructed and arranged so as to be simple and compact in structure, i.e., so as not to increase particularly the front-to-rear length of the loom. This is therefore effective for retaining a space for movement of a cloth beam carrier between the looms.

Figure 16:
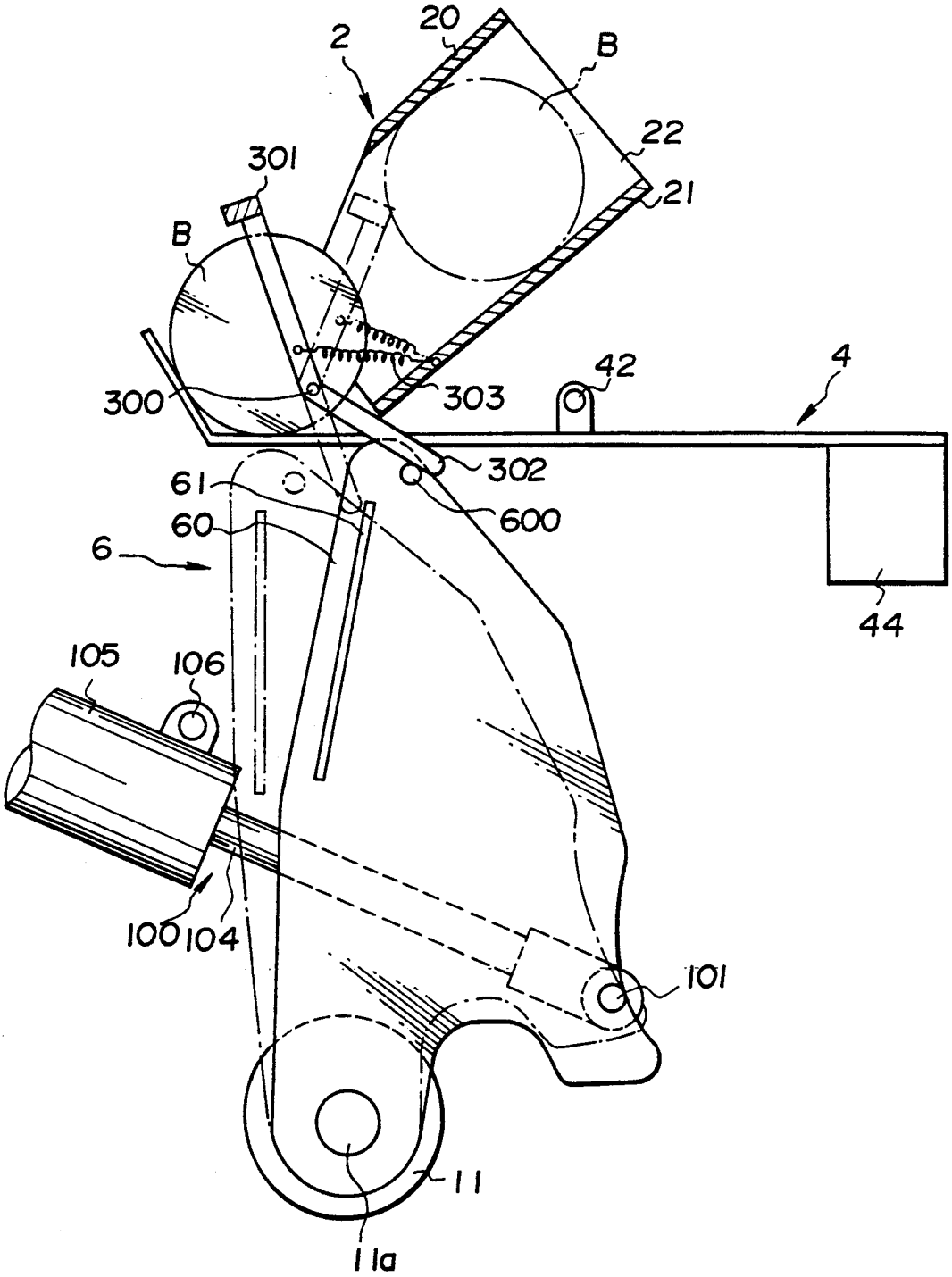
FIG. 16 is a view similar to FIG. 3 but shows a variant of the releasing mechanism of the empty cloth beam holder.

In the meantime, while the timed relation between the ejecting mechanism 6 and the releasing mechanism 3 has been described and shown as being attained by the base plates 60 and 60 and the stopper bars 30 and 30 installed thereon by way of the pins 101 and 101, this is not limitative but the releasing mechanism 3 may be constituted, as shown in FIG. 16 by a pair of angled levers 302 and 302 swingablly installed at intermediate potions thereof on stationary pins 300 and 300 and having one ends formed with abutment fingers 301 and 301 for abutment with the empty cloth beam "B" and the other ends abuttingly engageable with stopper pins 600 and 600 installed on the respective base plates 60 and 60. The levers 302 and 302 are urged by springs 303 and 303 into the positions where the abutment fingers 301 and 301 are abuttingly engageable with the cloth beam "B" for holding the same in the holder members 2*a* and 2*a*. The levers 302 and 302 are movable into the positions where the abutment fingers 301 and 301 are moved out of the positions for abutment with the cloth beam "B" in the holder members 2*a* and 2*a* being driven by the stopper pins 600 and 600 when the base plates 60 and 60 of the ejecting mechanism 6 are driven into predetermined forward positions.

Further, while the releasing mechanism 3 of the empty cloth beam holder 2 has been described shown as above, it is not limitative but may be considered, in a broader sense, as a supplying mechanism for supplying the cloth beam "B" from the cloth beam holder 2 to the driving mechanism 1.

We claim:

1. A loom comprising:

driving means for driving a first cloth beam to rotate and wind woven fabric thereon;

ejecting means for ejecting said first cloth beam from said driving means when a predetermined length of woven fabric is wound thereon;

a cloth beam support stand for supporting said first cloth beam ejected from said driving means;

a cloth beam holder for holding a second cloth beam and having supplying means operable in timed relation to said ejecting means for supplying said second cloth beam from said holder to said driving means;

cutter means for cutting the woven fabric and thereby separating the same from said first cloth beam while forming a loom side cut end portion in the cloth beam; and winding means for winding the loom side cut end portion of the woven fabric on said second cloth beam supplied to said driving means and having blowing means for blowing fluid in a first direction for placing the loom side cut end portion of the woven fabric on said second cloth beam and in a second direction different from said first direction, for holding the loom side cut end portion of the woven fabric on said second cloth beam.

2. The loom as claimed in claim 1 wherein said driving means comprises a pair of parallel front and rear rollers on which said first cloth beam is installed.

3. The loom as claimed in claim 2 wherein said winding means further comprises second blowing means for blowing fluid in a third direction different from said first and second directions, for holding the loom side cut end portion of the woven fabric on said second cloth beam, said first mentioned blowing means and said second blowing means comprising a blow-up nozzle disposed between said front roller and said cloth beam support stand for blowing fluid in said first direction and thereby blowing the loom side cut end portion of the woven fabric toward said second cloth beam on said front and rear rollers, a separator nozzle disposed between said front and rear rollers for blowing fluid in said second direction and thereby separating the loom side cut end portion of the woven fabric coming out of a space between said rear roller and said second beam on said front and rear rollers, from said rear roller, and a blow-in nozzle disposed between said front and rear rollers for blowing fluid in said third direction and thereby blowing the loom side cut end portion of the woven fabric into a space between said front roller and said second beam on said front and rear rollers.

4. The loom as claimed in claim 3 wherein said winding means further comprises a guide plate disposed between said blow-in nozzle and said front roller and cooperative with said blow-in nozzle for guiding the loom side cut end portion of the woven fabric into the space between said front roller and said second cloth beam on said front and rear rollers.

5. The loom as claimed in claim 4 wherein said separator nozzle blows fluid in the direction within an angular range defined between, with respect to a plane of projection perpendicular to axes of rotation of said front and rear rollers, a line extending from said separator nozzle and tangential to an outer periphery of said rear roller and a line extending between said separator nozzle and the axis of rotation of said front roller.

6. The loom as claimed in claim 5 wherein said blow-in nozzle blows fluid in the direction crossing a front-to-rear direction of extension of said guide plate.

7. The loom as claimed in claim 6, wherein said guide plate is adjustable in inclination by swinging forwardly and rearwardly.

8. The loom as claimed in claim 7 wherein said separator nozzle and said blow-in nozzle comprises a plurality of injection ports formed in a common pipe.

9. The loom as claimed in claim 8 wherein said injection ports are formed concentrically in respection plugs which are in turn screwed into said pipe.

10. The loom as claimed in claim 2 wherein said ejecting means comprises an ejecting arm movable to drive said first cloth beam out of the place on said front and rear rollers, and said supplying means comprises a stopper movable between a first position for allowing said second cloth beam to be held in said cloth beam holder and a second position for allowing said second cloth beam to be released from said cloth beam holder, said stopper and said ejecting arms being mechanically connected so as to operate in timed relation to each other.

11. The loom as claimed in claim 10, further comprising damper means disposed between said cloth beam holder and said driving means for catching said second cloth beam released from said cloth beam holder and on the way to said front and rear rollers of said driving means.

12. The loom as claimed in claim 4 wherein said damper means is operatively connected to said stopper of said supplying means for releasing said second cloth in timed relation to said ejection arm.

13. The loom as claimed in claim 5 wherein said damper means comprises a damper arm for guiding and holding said second cloth beam in parallel to said front and rear rollers.

14. The loom as claimed in claim 13 wherein said damper arm of said damper means is movable between a nearly horizontal position for holding said second cloth beam and an inclined position for releasing said second cloth beam.

15. The loom as claimed in claim 14 wherein said ejecting means further comprises a base plate swingable forwardly and rearwardly of the loom, said ejecting arm being installed on said base plate.

16. The loom as claimed in claim 15 wherein said damper means further comprises a cam for holding said damper arm in said nearly horizontal position, said cam being formed in said base plate of said ejecting means.

17. The loom as claimed in claim 16 wherein said damper arm has at one end a holding portion for holding said second cloth beam and at the other end a weight for allowing said damper arm to be held in contact with said cloth beam holder and thereby in said nearly horizontal position when said second cloth beam is held in said cloth beam holder and for allowing said damper arm to be movable into said inclined position by the weight of said second cloth beam when said second cloth beam is held by said holding portion.

18. The loom as claimed in claim 17 wherein said cam of said damper means is moved into a position for supporting said holding portion of said damper arm prior to releasing of sad second cloth beam from said cloth beam holder.

19. The loom as claimed in claim 18 wherein said holding portion of said damper arm is an obtusely angled end portion.

20. The loom as claimed in claim 19 wherein said ejecting means comprises a fluid cylinder for actuating said base plate to swing forwardly and rearwardly.

21. The loom as claimed in claim 20 wherein said stopper of said supplying means is in the form of an upstanding bar having an upper end portion movable into and out of said cloth beam holder and a lower end portion pivotally connected to said base plate.

22. The loom as claimed in claim 21 wherein said base plate is swingably installed at one end on a shaft on which said front roller of said driving means is installed.

23. The loom as claimed in claim 22 wherein said base plate is movable between a forward position for allowing said upper end portion of said stopper to move out of said cloth beam holder and a rearward position for allowing said upper end portion of said stopper to move into said cloth beam holder.

24. The loom as claimed in claim 23 wherein said cloth beam holder comprises a pair of channel-shaped holder members for receiving opposite axial end portions of said second cloth beam.

25. The loom as claimed in claim 1, further comprising a control unit for controlling operation of said ejecting means on the basis of an information whether said second cloth beam is installed on said cloth beam holder.

26. The loom as claimed in claim 25 wherein said control unit comprises means for stopping operation of said driving means in response to an information that a predetermined length of woven fabric is wound on said first cloth beam.

27. The loom as claimed in claim 26 wherein said control unit comprises means for producing an alarm signal in response to an information that installation of said second cloth beam on said cloth beam holder is required.

28. The loom as claimed in claim 1 wherein said cutter means comprises a rotary cutter blade and a fluid-drive motor for driving said rotary cutter blade.

29. The loom as claimed in claim 28 wherein said fluid-drive motor is of the kind for driving said rotary cutter blade to rotate at such high speed that enables cutting of the woven fabric in a loose state.

30. The loom as claimed in claim 1 wherein said cloth beam support stand comprises a base block for supporting a rolled woven fabric wound on said first cloth beam when a length of woven fabric wound on said first cloth beam is larger than a predetermined value, and a secondary support for supporting opposite end portions of said first cloth beam projecting outwardly from the rolled woven fabric when the length of woven fabric wound on said first cloth beam is smaller than a predetermined value.

* * * * *